US005318048A

United States Patent [19]

Stewart et al.

[11] Patent Number: 5,318,048

[45] Date of Patent: Jun. 7, 1994

[54] DEVICE FOR CUTTING THE PAPER SLEEVE OF DEFECTIVE FILTER CIGARETTES

[75] Inventors: Iain G. Stewart, Ennepetal; Peter Urban, Berlin; Alfred Brinker, Gevelsberg, all of Fed. Rep. of Germany

[73] Assignee: Maschinenfabrik Fr. Niepmann GmbH & Co., Gevelsberg, Fed. Rep. of Germany

[21] Appl. No.: 900,017

[22] Filed: Jun. 17, 1992

[30] Foreign Application Priority Data

Jun. 17, 1991 [DE] Fed. Rep. of Germany ..... 4119873

[51] Int. Cl.[5] ..... A24C 5/36

[52] U.S. Cl. ..... 131/96

[58] Field of Search ..... 131/96

[56] References Cited

U.S. PATENT DOCUMENTS

| | | | |
|---|---|---|---|
| 553,583 | 1/1896 | Hartigan | 131/96 |
| 1,091,775 | 3/1914 | Smith | 131/96 |
| 2,002,142 | 5/1935 | Gibson et al. | 131/96 |
| 3,665,931 | 5/1972 | Mizzau | 131/96 X |
| 4,261,790 | 4/1981 | Brinker et al. | 131/96 X |
| 4,278,100 | 7/1981 | Thatcher | 131/96 X |
| 4,485,827 | 12/1984 | Komossa et al. | 131/96 X |
| 5,000,196 | 3/1991 | Stewart et al. | 131/96 |
| 5,117,843 | 6/1992 | Holmes et al. | 131/96 |

*Primary Examiner*—William H. Grieb

*Attorney, Agent, or Firm*—Robert W. Becker & Associates

[57] ABSTRACT

A device for cutting the paper sleeve of defective filter cigarettes for recycling tobacco has at least one knife roller having a plurality of knife disks spaced from one another at a distance that is smaller than a diameter of the cigarettes. Each knife disk has a circumferential edge with a plurality of teeth. A conveyor belt feeds the cigarettes to the knife roller such that the cigarettes are essentially oriented parallel to the conveying direction. The conveyor belt and the knife roller are synchronized such that a circumferential velocity of the knife disks corresponds to the conveying velocity of the conveyor belt. As an alternative, the knife disks can be provided with a continuous circular dulled circumferential cutting surface. It is then necessary that the conveyor belt and the knife roller are synchronized such that a circumferential velocity of the knife disks is greater than the conveying velocity of the conveyor belt.

13 Claims, 1 Drawing Sheet

Fig.1
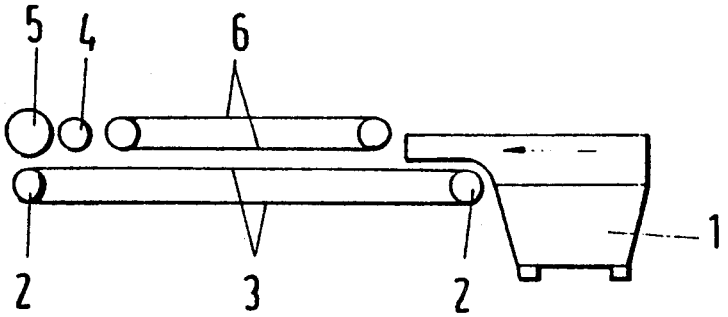
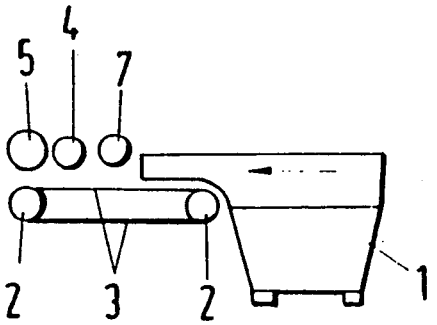
Fig.2
Fig.3
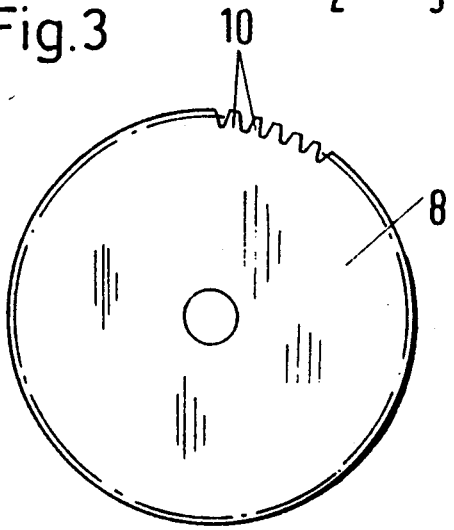
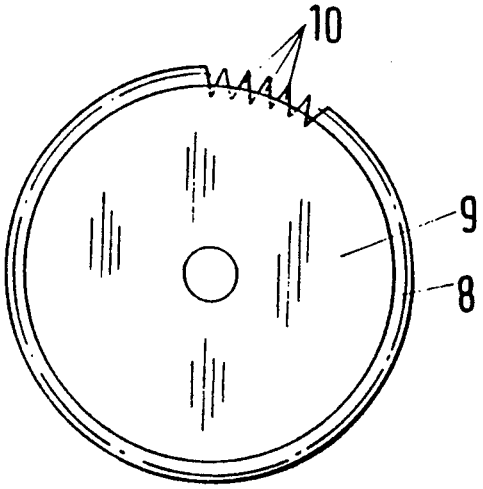
Fig.4
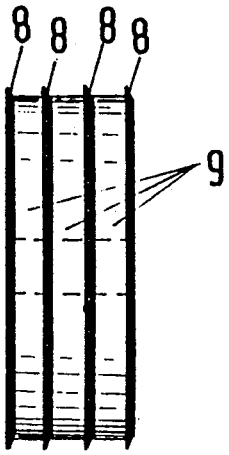
Fig.5

DEVICE FOR CUTTING THE PAPER SLEEVE OF DEFECTIVE FILTER CIGARETTES

BACKGROUND OF THE INVENTION

The present invention relates to a device for cutting the paper sleeve of defective filter cigarettes for recycling the tobacco, the device having a conveyor belt for feeding the cigarettes to a roller for opening the paper sleeves such that the cigarettes are essentially oriented parallel to the conveying direction.

From German Offenlegungschrift DE-OS 38 39 431 a device for recycling of tobacco from defective cigarettes is known in which the cigarettes which are essentially oriented parallel to the conveying direction are fed into a roller system by a conveyer belt which is wetted with water, wherein the roller system comprises at least one cutting roller with revolving knife rings. This cutting roller comprises either a plurality of knife rings which, in the form of closed individual rings, are arranged at an acute angle relative to the roller axis or with a coilshaped cutting knife extending over the entire length of the roller. In this manner it is ensured that the wetted paper sleeves of the cigarettes which are entering in axial orientation into the roller system are gently crushed without damaging the long fibers of the tobacco.

This known device has been successfully used in practice, however, an attentive and expensive service and cleaning is required since wet tobacco clumps are susceptible to molding.

It is therefore an object of the present invention to provide a device for cutting the paper sleeve of defective filter cigarettes of the aforementioned kind, in which the wetting of the transported goods is avoided and which is suitable for recycling the tobacco of defective filter cigarettes.

BRIEF DESCRIPTION OF THE DRAWINGS

This object, and other objects and advantages of the present invention, will appear more clearly from the following specification in conjunction with the accompanying drawings, in which:

FIG. 1 is a schematic side view of a first embodiment;

FIG. 2 is a schematic side view of a second embodiment;

FIG. 3 is a plan view of a first embodiment of a knife disk provided with teeth;

FIG. 4 is a plan view of a second embodiment of a knife disk provided with teeth and with spacer rings; and FIG. 5 is a side view of a portion of spacer rings and intermediate knife disks removed from a roller.

SUMMARY OF THE INVENTION

The device for cutting the paper sleeve of defective filter cigarettes for recycling tobacco according to the present invention is primarily characterized by:

At least one knife roller having a plurality of knife disks spaced from one another at a distance that is smaller than a diameter of the cigarettes, each knife disk having a circumferential edge with a plurality of teeth; and A conveyor belt for feeding the cigarettes to the roller such that the cigarettes are essentially oriented parallel to the conveying direction, wherein the conveyor belt and the knife roller are synchronized such that a circumferential velocity of the knife disks corresponds to a conveying velocity of the conveyor belt.

In an alternative solution to the object of the present invention the device comprises:

At least one knife roller having a plurality of knife disks spaced from one another at a distance that is smaller than a diameter of the cigarettes, each knife disk having a continuous circular dulled circumferential cutting surface; and A conveyor belt for feeding the cigarettes to the knife roller such that the cigarettes are essentially oriented parallel to the conveying direction, wherein the conveyor belt and the knife roller are synchronized such that a circumferential velocity of the knife disks is greater than a conveying velocity of the conveyor belt.

According to the present invention, the knife roller is provided with a plurality of knife disks that are spaced at a distance from one another which is smaller than the diameter of the cigarettes and are embodied such that they weaken the tobacco portion of the cigarette such that it bursts and that they presses or perforates the cover paper of the filter only to such an extent that the filter does not rupture so that no acetate fibers of the filter material will be set free.

It is preferably that the device further comprises spacer rings for holding the knife disks on the knife roller, the spacer rings having an outer mantle surface with a diameter that is slightly smaller than an outer diameter of the knife disks, so that the outer mantle surface together with the conveyor belt serves to convey the cigarettes.

Each tooth has preferably a head portion with a pressure surface for pressing onto the paper enclosure of the filter of the cigarette.

Alternatively, the device advantageously comprises spacer rings for holding the knife disks on the knife roller, the spacer rings having an outer mantle surface with a diameter that is greater than a diameter of the knife disks at a bottom between the teeth.

Preferably, the device in both embodiment further comprises an upper conveyor belt or an auxiliary roller positioned before the knife roller in the conveying direction, for cooperating with the conveyor belt. Advantageously, the distance between the upper conveyor belt or the auxiliary roller and the conveyor belt is smaller than the diameter of the cigarettes.

In the first alternative, this is achieved by the plurality of teeth provided at the circumferential edge of the knife disks effecting, due to the synchronization and adjustment of the circumferential velocity of the knife disks with the conveying speed of the conveyor belt, a perforation of the paper sleeve of the filter cigarettes aligned in the conveying direction. The paper sleeve thus perforated by the inventive device may be easily crushed so that the tobacco may be completely recycled. The stiffer enclosure of the filter which is more elastic due to the filter material is not destroyed by the plurality of teeth of the knife disks during this step. Even when smaller holes are produced within the filter enclosure, no filter particles will be introduced into the recycled tobacco. The filter may thus be removed in its entirety together with the cut-open paper sleeve from the device.

In the second alternative, the knife roller is provided with a pluarality of knife disks with continuous, circular dulled circumferential cutting surfaces. The cutting surfaces must be dulled to such an extent that the accordingly resulting pressure surfaces are sufficient to merely compress the filter with its enclosures, but are not great enough to prevent a cutting or weakening of the cigarette sleeve within the tobacco portion of the cigarette.

In this second alternative, the weakening, respectively, cutting of the paper sleeve is achieved due to the circumferential velocity of the revolving knife disks which is greater than the conveying velocity of the conveyor belt, whereby the stiffer enclosure of the filter which is more elastic due to the filter material is not cut open. Thus, with the second alternative of the present invention filter particles are not introduced into the recycled tobacco because even finer incisions in the filter enclosure will not result in a destruction of the filter which would lead to the release of filter particles.

The knife disks that are provided with teeth, according to a further feature of the present invention, may be held on the knife roller with spacer rings. The outer diameter of the spacer rings is only slightly smaller than the outer diameter of the knife disks so that the outer mantle surface of the spacer rings together with the conveyor belt serve as a conveying drive for the cigarettes. With this embodiment, any slip, which could result in a damage to the filter, between the cigarettes resting on the conveyor belt and the knife roller provided with the knife disks is prevented.

According to a further embodiment of the present invention, the teeth of the knife disks may be provided with a head portion that serves as a pressure surface acting on the enclosure of the filter. In this embodiment of the inventive device, it is ensured that the paper sleeves of the defective cigarettes are perforated, but the filter enclosure, due to its higher stiffness and elasticity, is not perforated or, cut but pushed away by the head portion.

Such an effect may also be achieved in another embodiment of the present invention by providing an outer diameter of the spacer ring that is greater than the diameter of the knife disk at the bottom of the teeth. Accordingly, it is possible that the teeth effect a perforation but no cutting of the paper sleeve and the filter enclosure. Accordingly, this embodiment also increases the reliability of the device with respect to the prevention of filter particles being introduced into the recycled tobacco.

In both inventive alternative embodiments it is advantageous when in front of the knife roller that is carrying the knife disks an upper conveyor belt or a further roller is provided for cooperation with the conveyor belt. With these embodiments it is ensured that the longitudinal orientation of the cigarettes is maintained, and also a directed and driven introduction of the cigarettes into the knife roller with the knife disks is effected.

When according to a further embodiment of the present invention the distance of the upper conveyor belt, respectively, of the auxiliary roller is smaller than the diameter of the cigarettes a flattening of the cigarettes will occur. With this embodiment not only a defined cutting plane for the knife disks is provided, but an increase of the tension within the paper enclosure, respectively, paper sleeve, which is favorable to the cutting process, and an enlargement of the engaging surface of the paper sleeve for the knife disks are achieved so that the reliability of the cutting process is increased.

The present invention provides a device for cutting the paper sleeve of defective filter cigarettes for recycling the tobacco. The inventive device not only prevents that filter material is introduced into the recycled tobacco, but also does not damage the valuable long fibers of the tobacco and furthermore prevents the formation of paper cuttings.

Description of Preferred Embodiments

The present invention will now be described in detail with the aid of several specific embodiments utilizing FIGS. 1 through 5.

In the two embodiments shown in FIGS. 1 and 2 a rotary conveyor 1 is shown. The defective filter cigarettes leave the rotary conveyor 1 in the direction of the arrow. The filter cigarettes are conveyed onto the upper belt portion of a conveyor belt 3 which is guided between two belt rollers 2. This conveyor belt 3 conveys the filter cigarettes, which are oriented parallel to the conveying direction, to a knife roller 4 which is driven synchronously to the conveyor belt 3. In both embodiments a pressure roller 5 is arranged behind the knife roller 4 in the direction of transportation of the filter cigarettes.

In the embodiment according to FIG. 1 an upper conveyor belt 6, in the direction of transportation, is arranged before the knife roller 4. The upper conveyor belt cooperates with the conveyor belt 3. Due to this cooperation, the filter cigarettes are conveyed to the knife roller 4 with a uniform orientation. In the embodiment according to FIG. 2 an auxiliary roller 7 is used for the same purpose in order to bridge the distance between the rotary conveyor 1 and the knife roller 4.

The knife roller 4 is comprised of a driven axle onto which a plurality of knife disks 8 are placed which are spaced from one another by spacer rings 9. The distance between the knife disks 8 is smaller than the diameter of the cigarettes. For a cigarette diameter of 8 mm the distance between the knife disks 8 is preferably 5 mm so that each cigarette conveyed on the conveyor belt 3 is reliably engaged by the knife roller 4.

The knife disks 8 may be provided with a continuous circular cutting surface. In this case, the drive of the knife roller 4 is synchronized with the drive of the conveyor belt 3 such that the circumferential velocity of the knife disks 8 is greater than the conveying velocity of the conveyor belt 3. With this measure, the paper sleeves of the filter cigarettes, due to the higher velocity of the knife disks 8, are reliably cut by the smooth circumference of the knife disks 8. Since the enclosure of the filter is thicker and made of a stiffer paper than the paper sleeve for the tobacco portion of the filter cigarette, and since the filter cigarette within the area of the filter is more resilient than within the area of the tobacco portion, the filter portion will yield under the influence of the rotating smooth-walled knife disks 8 without being damaged to such an extent that filter particles will result.

In the alternative embodiment knife disks 8 are used which, according to FIGS. 3 and 4, are provided with a plurality of teeth over their circumferential edge. In the embodiment according to FIG. 3, the teeth 10 are provided with a head portion acting as a pressure surf ace. In this embodiment the thinner and less elastic paper of the paper sleeve enclosing the tobacco is perforated, respectively, cut, while the usually two-layered enclosure of the filter gives with respect to the pressure surfaces of the teeth 10 due to the higher stiffness and greater elasticity of the filter so that the filter is not damaged.

The same result may be obtained with the knife disks 8 according to FIG. 4. The teeth 10 in this embodiment are provided with a pointed tip, however, the outer diameter of the spacer rings 9 on either side of the knife disk 8 is so great that it extends past the diameter of the knife disk 8 at the bottom between the teeth, as indicated with the dash-dotted line in FIG. 4. Accordingly, the upper half of the teeth 10 may perforate the paper sleeve enclosing the tobacco and may also penetrate the enclosure of the filter. Due to the greater elasticity of the filter however, only smaller holes will result in this enclosure which will not lead to material of the filter being introduced into the recycled tobacco.

For an embodiment of the knife disks 8 with a plurality of teeth 10, in order to avoid damage to the filter it must be ensured that the circumferential velocity of the knife disks 8 does not exceed the conveying velocity of the filter cigarettes and thus the conveying speed of the conveyor belt 3 to thereby avoid the cutting effect of a circular saw. Therefore, according to the embodiment of FIG. 5, the outer diameter of the spacer rings 9 is only slightly smaller than the outer diameter of the knife disks 8 provided with teeth 10. With this measure, the outer mantle surface of the spacer rings 9 cooperates with the conveyor belt 3 in the manner of a conveying drive. Accordingly, it is avoided that cigarettes will be jammed between the knife disks 8 and held back. Thus, undesired damage to the filter in this manner is also prevented.

The pressure roller 5 arranged behind the knife roller 4 in the direction of transportation ensures that only the paper sleeves that have been perforated by the knife roller 4 will burst so that the tobacco contained in the cigarettes is completely removed. The upper conveyor belt 6, or the auxiliary roller 7 used instead, which is placed before the knife roller 4 in the direction of transportation not only provides a directed feeding of the filter cigarettes to the knife rollers 4, but also, with a respective adjustment of the distance to the conveyor belt 3, flattens the respectively fed filter cigarettes so that a defined cutting plane for the knife disks 4 results and the tension in the paper sleeve to be cut is increased. Accordingly, even when weakened, for example, by perforation, the paper sleeves burst essentially automatically.

The present invention is, of course, in no way restricted to the specific disclosure of the specification and drawings, but also encompasses any modifications within the scope of the appended claims.

What we claim is:

1. A device for cutting the paper sleeve of defective filter cigarettes for recycling tobacco, said device comprising:

at least one knife roller having a plurality of knife disks spaced from one another at a distance that is smaller than a diameter of the cigarettes, each said knife disk having a circumferential edge with a plurality of teeth; and a conveyor belt for feeding the cigarettes to said knife roller such that the cigarettes are essentially oriented parallel to the conveying direction, wherein said conveyor belt and said knife roller are synchronized such that a circumferential velocity of said knife disks corresponds to a conveying velocity of said conveyor belt.

2. A device according to claim 1, further comprising spacer rings for holding said knife disks on said knife roller, said spacer rings having an outer mantle surface with a diameter that is slightly smaller than an outer diameter of said knife disks, so that said outer mantle surface together with said conveyor belt serves to convey the cigarettes.

3. A device according to claim 1, wherein each said tooth has a head portion with a pressure surface for pressing onto the paper enclosure of the filter of the cigarette.

4. A device according to claim 1, further comprising spacer rings for holding said knife disks on said knife roller, said spacer rings having an outer mantle surface with a diameter that is greater than a diameter of said knife disks at a bottom between said teeth.

5. A device according to claim 1, further comprising an upper conveyor belt, positioned before said knife roller in said conveying direction, for cooperating with said conveyor belt.

6. A device according to claim 5, wherein a distance between said upper conveyor belt and said conveyor belt is smaller than said diameter of the cigarettes.

7. A device according to claim 1, further comprising an auxiliary roller, positioned before said knife roller in said conveying direction, for cooperating with said conveyor belt.

8. A device according to claim 7, wherein a distance between said auxiliary roller and said conveyor belt is smaller than said diameter of the cigarettes.

9. A device for cutting the paper sleeve of defective cigarettes for recycling tobacco, said device comprising:

at least one knife roller having a plurality of knife disks spaced from one another at a distance that is smaller than a diameter of the cigarettes, each said knife disk having a continuous circular dulled circumferential cutting surface; and a conveyor belt for feeding the cigarettes to said knife roller such that the cigarettes are essentially oriented parallel to the conveying direction, wherein said conveyor belt and said knife roller are synchronized such that a circumferential velocity of said knife disks is greater than a conveying velocity of said conveyor belt.

10. A device according to claim 9, further comprising an upper conveyor belt, positioned before said knife roller in said conveying direction, for cooperating with said conveyor belt.

11. A device according to claim 10, wherein a distance between said upper conveyor belt and said conveyor belt is smaller than said diameter of the cigarettes.

12. A device according to claim 9, further comprising an auxiliary roller, positioned before said knife roller in said conveying direction, for cooperating with said conveyor belt.

13. A device according to claim 12, wherein a distance between said auxiliary roller and said conveyor belt is smaller than said diameter of the cigarettes.

* * * * *